US007874390B2

(12) United States Patent
Taniuchi et al.

(10) Patent No.: US 7,874,390 B2
(45) Date of Patent: Jan. 25, 2011

(54) WORKING MACHINE

(75) Inventors: Tomoya Taniuchi, Hiroshima (JP); Koji Yonezawa, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 324 days.

(21) Appl. No.: 11/678,802

(22) Filed: Feb. 26, 2007

(65) Prior Publication Data

US 2007/0272461 A1 Nov. 29, 2007

(30) Foreign Application Priority Data

Mar. 30, 2006 (JP) ..... 2006-093388

(51) Int. Cl.
*B60K 11/04* (2006.01)

(52) U.S. Cl. ..... 180/68.4; 180/68.3; 180/68.6

(58) Field of Classification Search ..... 180/68.1, 180/68.2, 68.4, 68.6, 291
See application file for complete search history.

(56) References Cited

U.S. PATENT DOCUMENTS

| | | | | |
|---|---|---|---|---|
| 4,287,961 | A * | 9/1981 | Steiger | 180/68.4 |
| 6,390,770 | B1 * | 5/2002 | Takeshita | 415/119 |
| 6,622,668 | B2 * | 9/2003 | Izumi | 123/41.49 |
| 2002/0104239 | A1 * | 8/2002 | Naruse et al. | 37/348 |
| 2004/0188157 | A1 * | 9/2004 | Miyachi | 180/68.4 |
| 2005/0279548 | A1 * | 12/2005 | Kurtz et al. | 180/68.6 |

FOREIGN PATENT DOCUMENTS

| | | |
|---|---|---|
| JP | 7-207702 | 8/1995 |
| JP | 11-81960 | 3/1999 |
| JP | 11-286961 | 10/1999 |
| JP | 2000-204588 | 7/2000 |
| JP | 2000-204590 | 7/2000 |
| JP | 2000-336694 | 12/2000 |
| JP | 2004-300675 | 10/2004 |
| JP | 3649147 | 2/2005 |
| JP | 2005-319838 | 11/2005 |

* cited by examiner

*Primary Examiner*—J. Allen Shriver, II
*Assistant Examiner*—Bryan A Evans
(74) *Attorney, Agent, or Firm*—Oblon, Spivak, McClelland, Maier & Neustadt, L.L.P.

(57) ABSTRACT

On the premise that a partition wall for defining an engine room is provided on the left side of a rear portion of an upper frame the partition wall constituting an upper rotating body and that an engine and a cooler are disposed in the engine room, a front support frame which supports a front portion of the cooler is connected to a rear surface of the partition wall in a state of surface abutment against the rear surface, whereby the support frame also serves as a support pillar for the partition wall, the partition wall also serves as a stay for the prevention of transverse vibration of the support frame, and the use of a sealing member for filling up a gap between the partition wall and the support frame can be omitted.

7 Claims, 7 Drawing Sheets

WORKING MACHINE

BACKGROUND OF THE INVENTION

1. Field of the Invention

The present invention relates to a working machine equipped with an upper rotating body such as a hydraulic excavator.

2. Description of the Related Art

THE RELATED ART will be described with a hydraulic excavator as an example. Reference will here made to a small-sized excavator called a small swing type wherein an upper rotating body rotates within the width of a vehicle.

In FIG. 7, a cooler 13 is configured as a cooler assembly having plural kinds of cooler elements, e.g., radiator 13*a*, oil cooler 13*b* and inter-cooler 13*c*. In the same figure, the oil cooler 13*b*, radiator 13*a* and inter-cooler 13*c* are arranged in this order from the front side and are all supported by a single cooler frame 14.

The cooler frame 14 is made up of front and rear support frames 15, 16 which are ⊐-shaped in plan and fixed to a bottom plate of an upper frame shown in FIG. 8, as well as connecting frames 17 which connect the support frames 15 and 16 with each other.

A stay 18 for preventing transverse vibration of the front support frame 15 is mounted between the front support frame 15 and the upper frame fixed portion.

On the other hand, a partition wall 19 is provided in the transverse direction to define an engine room 9. The partition wall is also provided in other portions of the upper frame indicated at 8, but the illustration and explanation thereof are omitted.

The partition wall 19 is provided separately and independently of the front support frame 15 of the cooler frame 14 so as to form a gap C between the two. A sealing member 20 for preventing the flow of air is disposed in the gap C.

A pair of portions indicated at 21 in FIG. 7 are a pair of right and left longitudinal walls (designated main frames) which are disposed at rear positions of a central portion (designated a center deck) in the transverse direction of the upper frame 8. One end of the stay 18 is secured, for example, to the left main frame 21. Numeral 22 denotes a counterweight attached to a rear end portion of the upper frame.

In connection with the above configuration, a basic configuration of the upper frame and the layout of devices are disclosed in Japanese Patent No. 3649147, the sealing structure between the cooler and the partition wall is disclosed in Japanese Patent Laid-Open No. 2000-204590, and the cooler support structure is disclosed in Japanese Patent Laid-Open No. 2004-300675.

However, these configurations involve the following problems.

(i) It is necessary that the partition wall 19 should ensure a required strength by itself, thus requiring the use of a panel having a large thickness (i.e., a heavy panel).

(ii) It is necessary that the sealing member 20 for filling up the gap C be disposed between the partition wall 19 and the front support frame 15.

(iii) It is necessary to use the stay 18 as a special part for preventing the transverse vibration of the front support frame 15.

As a result, the parts cost and material cost become high, the partition wall 19 becomes heavy as in the above (i), and the number of parts increases as in the above (ii) and (iii), with a consequent increase in the number of assembling steps and deterioration of the assembling work efficiency.

SUMMARY OF THE INVENTION

It is an object of the present invention to provide a working machine capable of reducing the number of parts, including a support frame for supporting the front portion of a cooler, a partition wall and related portions, reducing the cost and improving the assembling work efficiency.

The working machine of the present invention has the following basic configuration.

The working machine of the present invention is equipped with a lower traveling body and an upper rotating body mounted on the lower traveling body. A partition wall is provided in a rear portion of an upper frame, the partition wall constituting the upper rotating body and in the transverse direction (right-and-left direction) of a machine body, whereby an engine room is defined behind the partition wall.

The working machine of the present invention is further equipped with an engine and a cooler both disposed in the engine room, as well as a support frame for supporting a front portion of the cooler. The partition wall and the support frame are connected with each other in a state in which the support frame also serves as a support pillar for supporting the partition wall.

Since the partition wall and the support frame are thus connected together in a state in which the support frame which supports the front portion of the cooler also serves as a support pillar (reinforcing member) for the partition wall, firstly it becomes possible to lower the strength (reduce the panel thickness) of the panel itself which constitutes the partition wall.

Secondly, since the partition wall and the support frame are connected together, the use of a sealing member such as urethane for filling up the gap between the two becomes unnecessary.

Thirdly, since the partition wall functions as a stay for stopping the transverse vibration of the support frame, the use of a special stay can be omitted.

That is, if attention is paid to the point that the support frame is a high strength member and that the support frame and the partition wall are disposed in proximity to each other, then by connecting the two in a mutually reinforcing relation although the two are originally unrelated to each other, it is possible to attain the reduction in the number of parts, reduction in cost of parts and materials and reduction of weight, as noted above. Besides, as a result of reduction in the number of parts and in weight it is possible to greatly improve the assembling work efficiency.

It is preferable to adopt a configuration wherein the support frame and the partition wall are in abutment against each other in the longitudinal direction. According to this configuration, a basic positional relation in the longitudinal direction between the support frame and the partition wall is the same as in the prior art, so even if a structural change is performed for the support frame, etc., the change can be minimized.

It is preferable to adopt a configuration wherein the support frame and the partition wall are connected together in a transversely continuous state. According to this configuration, the size of the partition wall can be reduced because the support frame also serves as a part of the partition wall. Consequently, in case of constituting the partition wall with use of plural divided panels, the number of panels used and the panel area become smaller, whereby it is possible to attain a further reduction of cost and reduction of the number of assembling steps.

DESCRIPTION OF THE PREFERRED EMBODIMENTS

Figure 7:
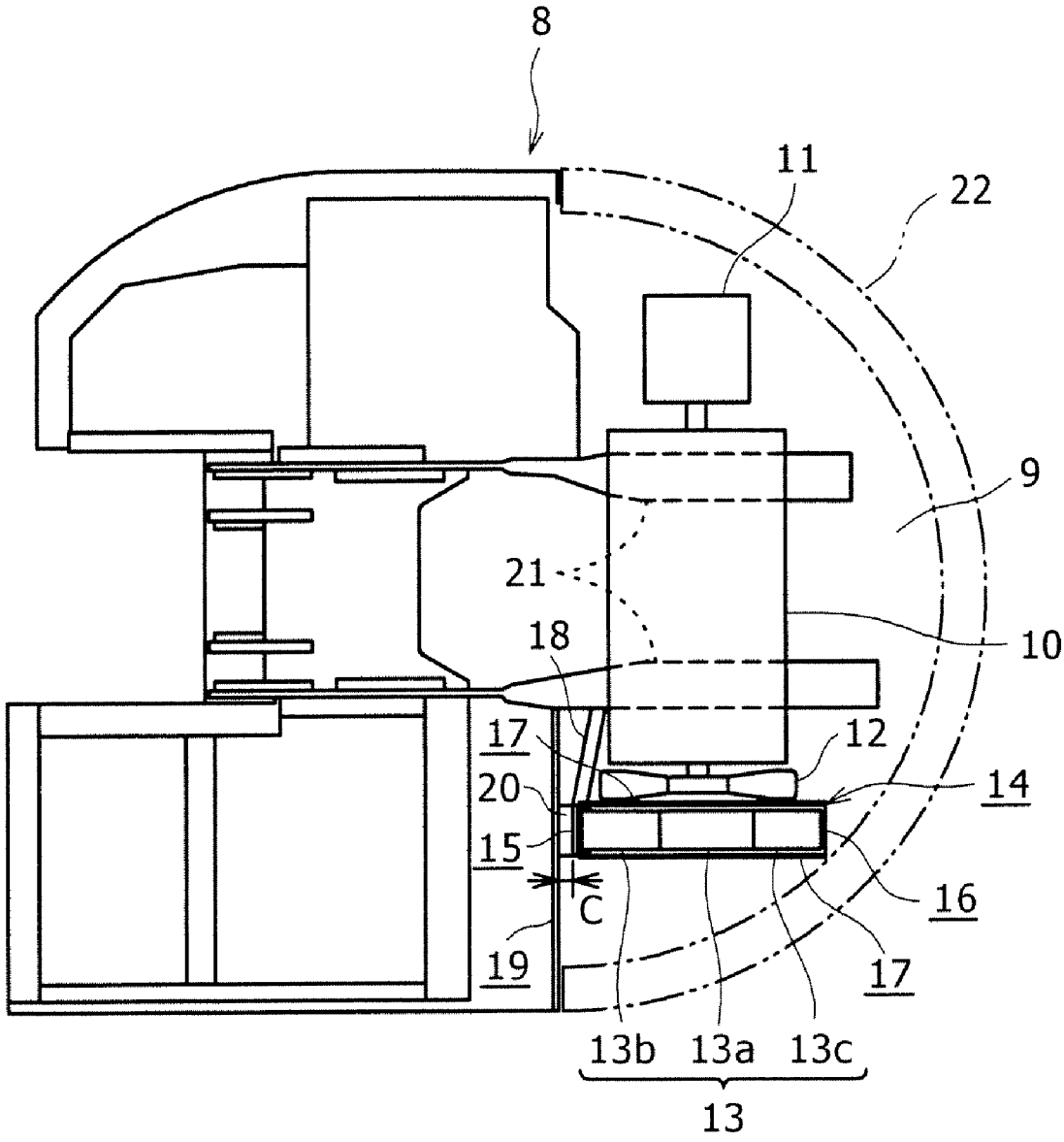
FIG. 7 is a plan view of a conventional upper frame.
Figure 8:
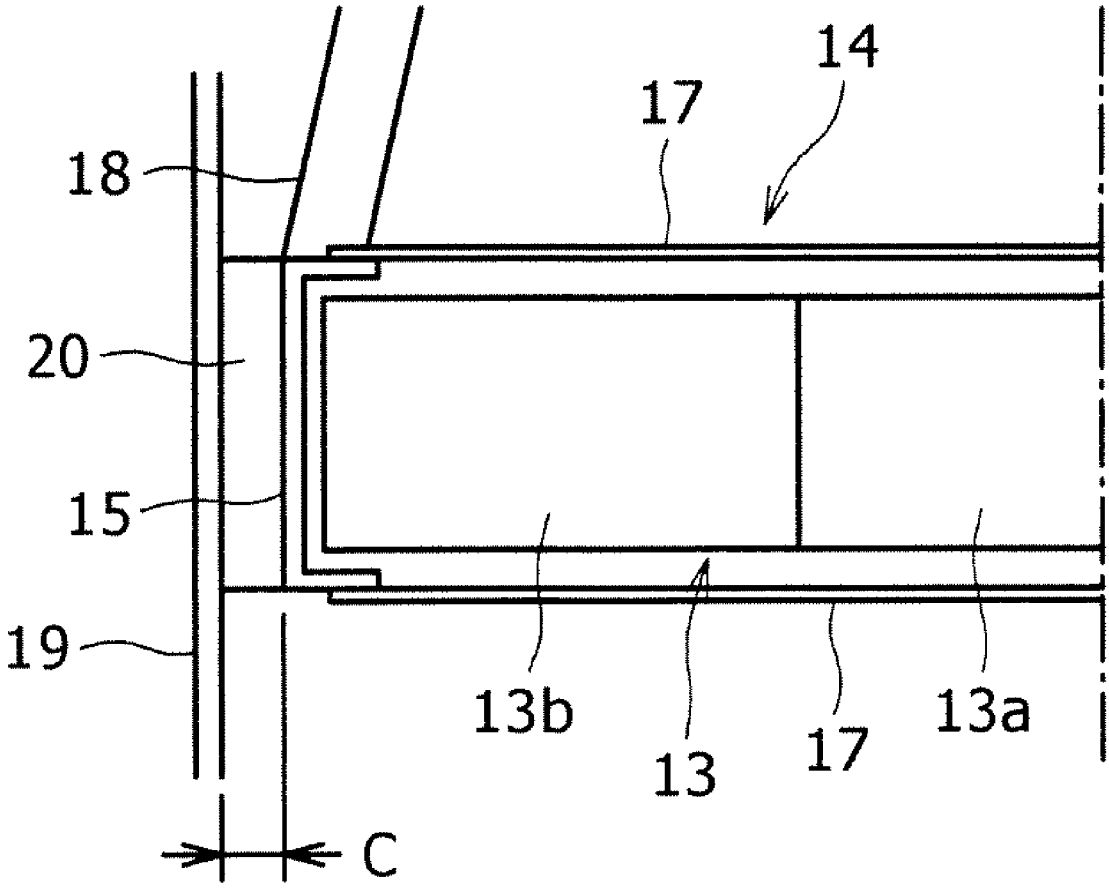
FIG. 8 is a partially enlarged diagram of FIG. 7.

Basically, in the following embodiments, the same portions as in THE RELATED ART shown in FIGS. 7 and 8 are identified by the same reference numerals and tautological explanations thereof will be omitted.

Reference will be made to a small-sized excavator called a small swing type wherein an upper rotating body rotated within the width of the excavator.

Figure 5:
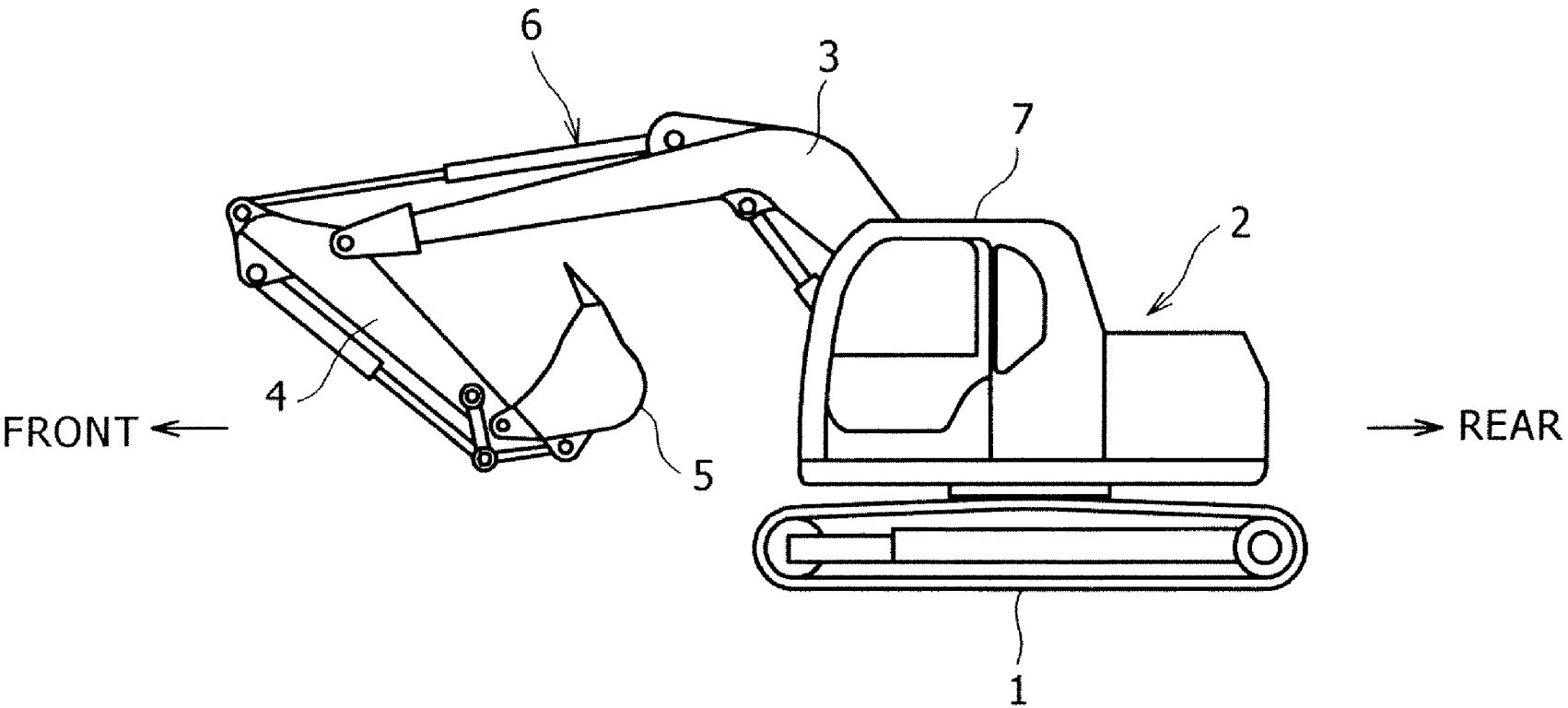
FIG. 5 is a schematic side view of a hydraulic excavator.
Figure 6:
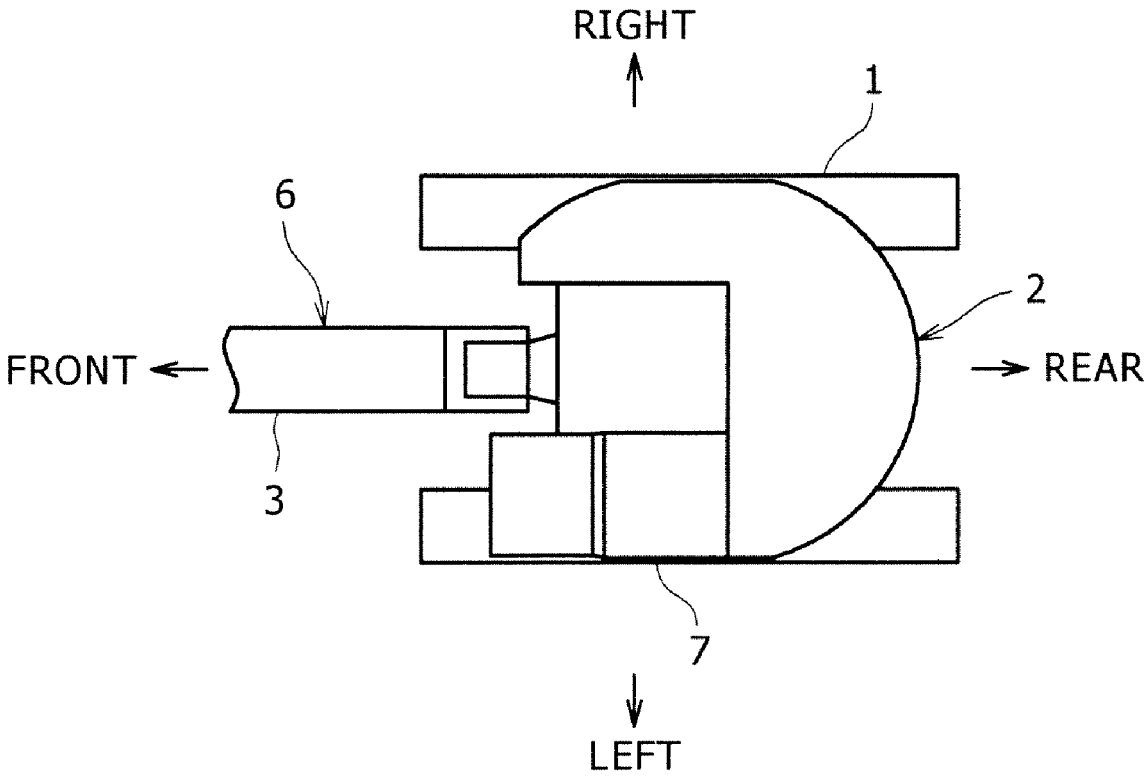
FIG. 6 is a schematic plan view of the hydraulic excavator.

In FIGS. 5 and 6, reference numeral 1 denotes a crawler type lower traveling body and reference numeral 2 denotes an upper rotating body mounted rotatably on the lower traveling body 1. A working attachment 6 having a boom 3, an arm 4 and a bucket 5 is attached to a front portion of the upper rotating body 2, and a cabin 7 is installed in a left front portion of the upper rotating body.

Figure 1:
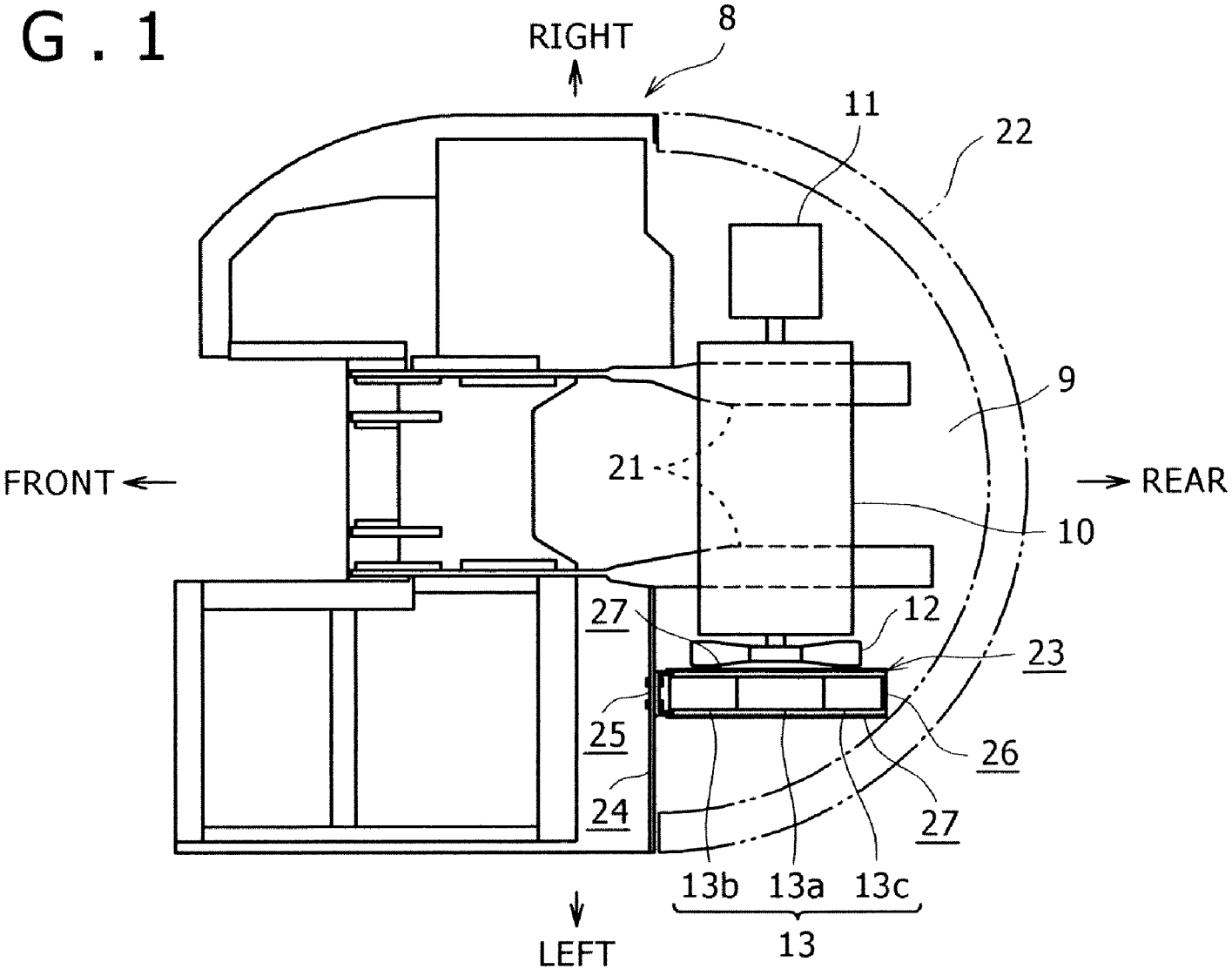
FIG. 1 is a plan view of an upper frame in an excavator according to a first embodiment of the present invention.

FIG. 1 shows an upper frame 8 which constitutes the upper rotating body 2, as well as various portions mounted thereon. In the same figure, for simplification thereof, there are illustrated only structures and portions related to the present invention.

An engine room 9 is formed in a rear portion of the upper frame 8 and an engine 10 as a power source is installed in the engine room 9.

On the right side of the engine room 9 is disposed a hydraulic pump 11 which is driven by the engine 10, while on the left side of the engine room 9 are disposed a cooling fan 12 and a cooler 13.

Figure 2:
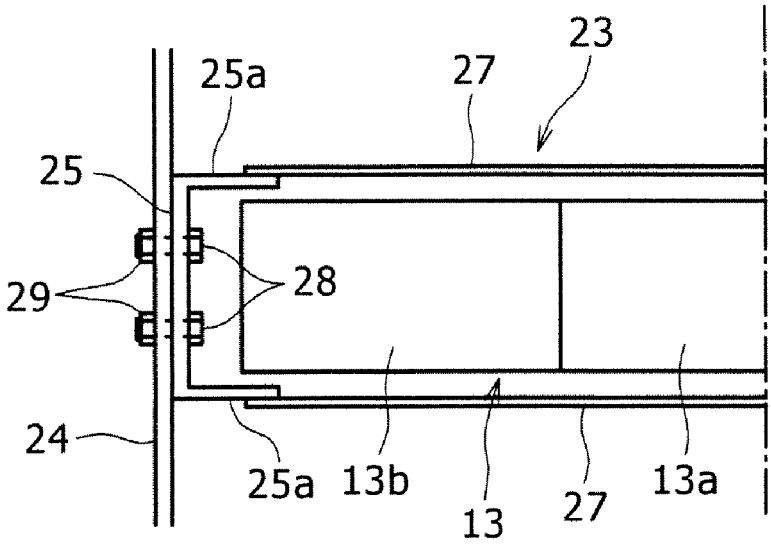
FIG. 2 is a partially enlarged diagram of FIG. 1.

First Embodiment (See FIGS. 1 and 2)

In a first embodiment of the present invention the following configuration points are the same as in THE RELATED ART shown in FIGS. 7 and 8:

(i) The engine room 9 is formed in the rear portion of the upper frame 8 and the engine 10 is installed in the engine room 9.

(ii) The hydraulic pump 11 is disposed on the right side of the engine 10 and the cooling fan 12 and the cooler 13 are disposed on the left side of the engine 10. The cooler 13 is configured as a cooler assembly wherein three cooler elements, i.e., oil cooler 13*b*, radiator 13*a* and inter-cooler 13*c*, are arranged in this order from the front side and supported by a cooler frame 23.

(iii) A partition wall 24 for defining the engine room 9 is provided in the transverse direction behind the cabin.

The cooler frame 23 is composed of front and rear support frames 25, 26 fixed to the upper frame 8, the support frames 25 and 26 being ⊐-shaped in plan (generally U-shaped in plan), and plural connecting frames 27 for connecting the support frames 25 and 26 with each other.

In this embodiment, the front support frame 25 is positioned ahead of the front support frame 15 shown in FIGS. 7 and 8 and is connected to a rear surface of a partition wall 24 in a state of surface abutment against the rear surface directly (without leaving any gap) with plural sets of bolts 28 and nuts 29.

That is, the front support frame 25 and the partition wall 24 are connected together in a state in which the front support frame 25 which supports a front portion of the cooler 13 also functions as a support pillar which supports the partition wall 24, while the partition wall 24 also functions as a stay for preventing the transverse vibration of the front support frame 25.

As means for positioning the front support frame 25 ahead of the conventional position, both right and left bent portions 25*a* of the support frame 25 may be formed long in the longitudinal direction as shown in the drawings. Alternatively, the cooler frame 23, cooler 13 and engine 10 may be disposed in front positions as a whole. The support structure itself of the cooler 13 for the front support frame 25 may be the same as in the prior art.

According to this configuration, the partition wall 24 is reinforced by the front support frame 25. In proportion to this reinforcement it is possible to decrease the strength of the panel itself which constitutes the partition wall 24 and thereby reduce the panel thickness (weight).

Moreover, since the partition wall 24 and the front support frame 25 are directly connected with each other and the gap C shown in FIG. 7 is not formed between the two, the sealing member 20 which has heretofore been required for filling up the gap C is no longer required.

Further, as noted above, the partition wall 24 functions as a stay for stopping the transverse vibration of the front support frame 25. Consequently, the stay 18 shown in FIGS. 7 and 8 also becomes unnecessary.

As a result, it is possible to greatly reduce the cost of materials and parts and reduce the number of parts and the weight of the partition wall 24, whereby the assembling work efficiency can be improved to a greater extent than in the prior art.

Additionally, all that is required is merely connecting the partition wall 24 and the front support frame 25 which are disposed front and rear in proximity to each other, in other words, the basic positional relation such that the front support frame 25 is positioned behind the partition wall 24 is the same as in the prior art. Therefore, even if the front support frame 25 is positioned ahead of the present position, the amount of the movement may be small. Thus, even if there is made a change such as increasing the longitudinal size of the bent portions 25*a* of the front support frame 25 as noted earlier, the change may be small.

Figure 3:
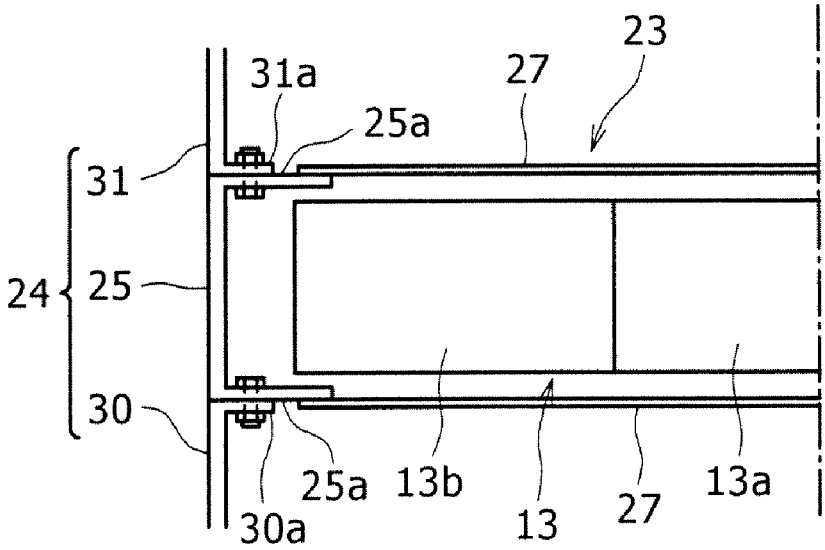
FIG. 3 is a diagram corresponding to FIG. 2, showing a second embodiment of the present invention.
Figure 4:
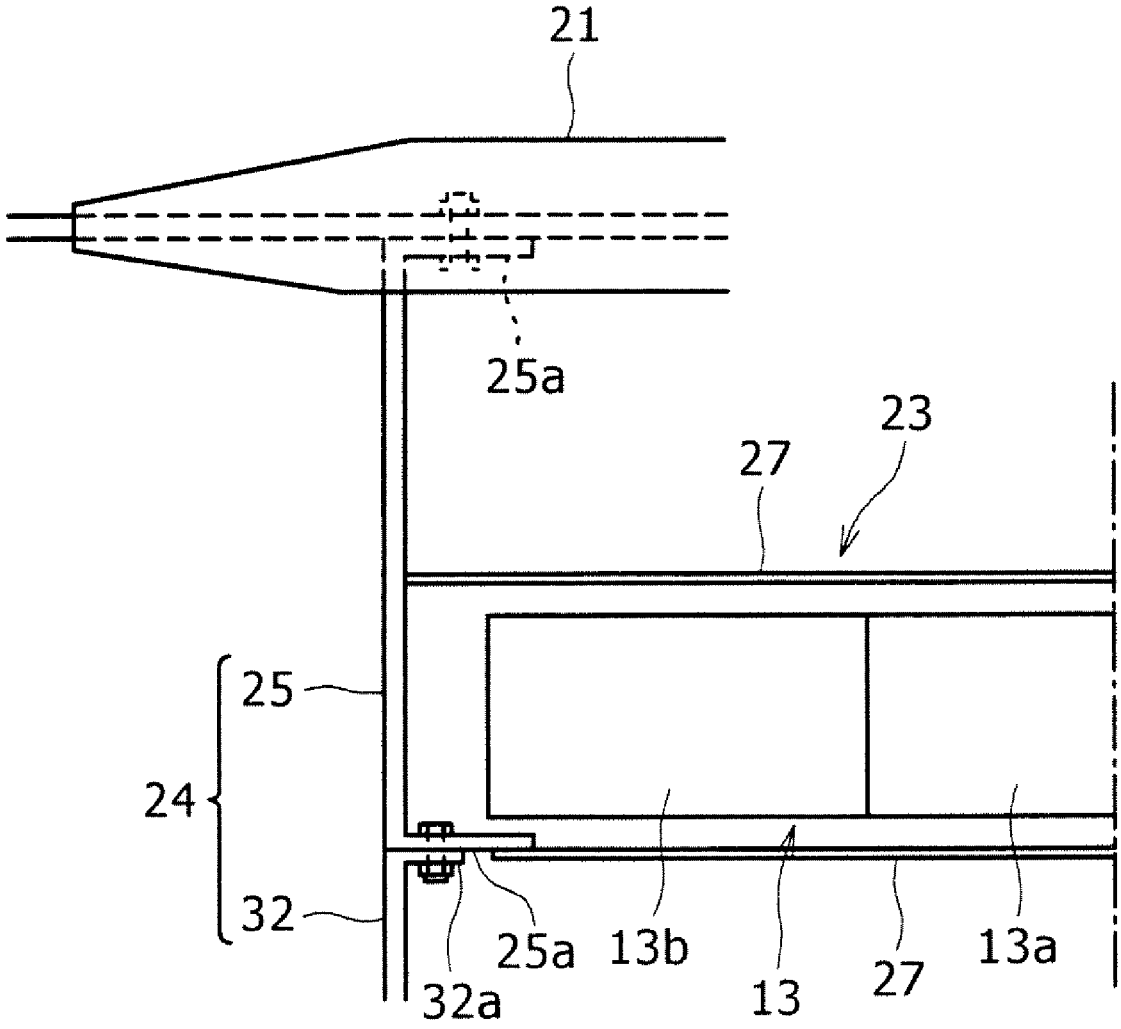
FIG. 4 is a diagram corresponding to FIG. 2, showing a third embodiment of the present invention.

Second & Third Embodiments (See FIGS. 3 and 4)

A description will be given below only about the difference from the first embodiment.

In second and third embodiments of the present invention illustrated in FIGS. 3 and 4, respectively, a front support frame 25 and a partition wall 24 are connected together in a transversely continuous state, that is, the front support frame 25 functions not only as a support pillar for the partition wall 24 but also as a part of the entire partition wall.

In the second embodiment, the partition wall 24 is divided to left and right panels 30, 31 and the front support frame 25 and the divided panels 30, 31 are connected together in a state in which the front support frame 25 is sandwiched in between both divided panels 30 and 31. In this configuration, the partition wall 24 is constituted by both divided panels 30, 31 and the front support frame 25.

On the other hand, according to the third embodiment, in the case where a partition wall 24 is made up of, say, two divided panels, the transverse size of a front support frame 25 is set large to approximately the same degree as the width of one divided panel and the support frame 25 and the other divided panel are connected together at respective one ends in a transversely continuous state and in a state wherein the support frame 25 also serves as one divided panel. In this configuration, the partition wall 24 is constituted by a divided panel 32 and the front support frame 25.

In FIGS. 3 and 4 there is illustrated a configuration wherein bent portions 30*a*, 31*a* and 32*a* are formed at end portions of the divided panels 30, 31 and 32, respectively, and are bolted to bent portions 25*a* of the front support frame 25. However, there may be adopted a configuration wherein end faces of the divided panels 30, 31 and 32 are abutted against the front support frame 25 and in this state are welded to the front support frame or a configuration wherein panel ends are superimposed on the front surface of the support frame 25 and are bolted or welded thereto.

In the third embodiment illustrated in FIG. 4, the other end portion (the opposite-side end portion 25*a* in the illustrated example) of the front support frame 25 is secured to an upper frame fixing portion such as a left main frame 21 as shown in the same figure.

According to both second and third embodiments, since the front support frame 25 serves also as a part (panel) of the partition wall 24, the area of the partition wall can be made smaller. Therefore, in case of forming the partition wall 24 with use of plural divided panels as described above, it is possible to attain a further reduction of cost and improvement of the assembling work efficiency because the number of panels and the panel area are decreased.

The present invention is applicable also to the case where the radiator 13*a*, oil cooler 13*b* and inter-cooler 13*c* as cooler elements, i.e, cooling devices are arranged side by side in the transverse direction. In this case, when the cooler elements are supported by a single cooler frame as a common cooler frame, a front support frame of the cooler frame and the partition wall may be connected together as in the embodiment just described above. In the case where the cooler elements are supported by separate cooler frames, a front support frame in one of them (e.g., a cooler frame for radiator) and the partition wall may be connected together.

The present invention is also applicable in the same manner as above to a working machine wherein a cooler is disposed on the right side of the engine room and a partition wall is provided on the right side of the rear portion of the upper frame.

Although the invention has been described with reference to the preferred embodiments in the attached figures, it is noted that equivalents may be employed and substitutions made herein without departing from the scope of the invention as recited in the claims.

We claim:

1. A working machine comprising:

a lower traveling body;

an upper rotating body mounted on said lower traveling body;

a partition wall provided on the upper rotating body and extending in a direction generally transverse to a longitudinal direction, said partition wall being positioned forward of an engine room to partition said engine room from a portion of the upper rotating body forward of the engine room;

an engine and a cooler both disposed in said engine room; and a support frame for supporting a front portion of said cooler, said support frame being attached to said upper rotating body and to said partition wall in a state in which the support frame also serves as a part of the partition wall.

2. The working machine according to claim 1, wherein said support frame and said partition wall are connected together in a mutually contacted state in the longitudinal direction of the machine body.

3. The working machine according to claim 1, wherein said support frame and said partition wall are connected together in a continuous state in the transverse direction of the machine body.

4. The working machine according to claim 1, wherein said cooler comprises plural kinds of cooling devices, said plural kinds of cooling devices being arranged longitudinally within a common cooler frame, wherein said support frame is disposed in front of said cooler frame.

5. The working machine according to claim 1, wherein said upper rotating body further comprises an operator cabin forward of the partition wall, wherein said partition wall partitions said operator cabin from said engine room.

6. The working machine according to claim 2, wherein said support frame extends substantially colinear with the partition wall, to serve as a part of the partition wall.

7. A working machine comprising:

a lower traveling body;

an upper rotating body mounted on said lower traveling body;

a partition wall provided on the upper rotating body and extending in a direction generally transverse to a longitudinal direction, said partition wall being positioned forward of an engine room to partition said engine room from a portion of the upper rotating body forward of the engine room;

an engine and a cooler both disposed in said engine room; and a support frame for supporting a front portion of said cooler, said support frame being attached to said upper rotating body and integrated into said partition wall such that the support frame forms a part of the partition wall.

* * * * *